US007462957B2

(12) United States Patent
Camwell et al.

(10) Patent No.: US 7,462,957 B2
(45) Date of Patent: Dec. 9, 2008

(54) MULTI-CONDUCTOR PLUG AND SOCKET APPARATUS

(75) Inventors: Paul L. Camwell, Calgary (CA); Wendall L. Siemens, Calgary (CA); Derek W. Logan, Calgary (CA); Jili Liu, Calgary (CA)

(73) Assignee: Extreme Engineering Ltd., Calgary, Alberta (CA)

( * ) Notice: Subject to any disclaimer, the term of this patent is extended or adjusted under 35 U.S.C. 154(b) by 540 days.

(21) Appl. No.: 10/655,028

(22) Filed: Sep. 5, 2003

(65) Prior Publication Data

US 2005/0052796 A1 Mar. 10, 2005

(51) Int. Cl.
*H01H 35/00* (2006.01)

(52) U.S. Cl. ..... 307/131

(58) Field of Classification Search ..... 307/147, 307/112, 116, 125, 131
See application file for complete search history.

(56) References Cited

U.S. PATENT DOCUMENTS

| | | | | |
|---|---|---|---|---|
| 4,346,419 | A | 8/1982 | Janniello | 361/2 |
| 5,048,914 | A | 9/1991 | Sneddon | 385/53 |
| 5,409,403 | A | 4/1995 | Falossi et al. | 439/688 |
| 5,580,261 | A | 12/1996 | Meynier | 439/188 |
| 5,726,506 | A * | 3/1998 | Wood | 307/147 |
| 5,949,160 | A * | 9/1999 | Anderson et al. | 307/140 |
| 5,984,687 | A | 11/1999 | Schwarz | 439/17 |
| 6,192,435 | B1 * | 2/2001 | Takahashi | 710/302 |
| 6,435,917 | B1 | 8/2002 | McDonald et al. | 439/669 |
| 6,439,932 | B1 | 8/2002 | Ripolone | 439/668 |
| 6,528,746 | B2 | 3/2003 | DeWitt et al. | 200/51.09 |
| 6,554,490 | B1 * | 4/2003 | Sumi et al. | 385/88 |
| 2003/0122428 | A1 * | 7/2003 | Rice-McDonald | 307/10.3 |
| 2004/0132337 | A1 * | 7/2004 | Plishner | 439/577 |
| 2005/0070141 | A1 * | 3/2005 | Dopf et al. | 439/140 |

* cited by examiner

*Primary Examiner*—Michael J Sherry
*Assistant Examiner*—Daniel Cavallari

(57) ABSTRACT

An electronic switching circuit system designed to be compatible with coaxial barrel style plug and socket connectors. Specific plug and socket contacts utilize a simple electronic device that causes the switching circuit associated with either or both the plug and socket to be activated only when the plug and socket pair is fully engaged.

12 Claims, 8 Drawing Sheets

MULTI-CONDUCTOR PLUG AND SOCKET APPARATUS

FIELD OF THE INVENTION

This invention relates to electrical connections, and more particularly electrical connections that are electrically activated only when such connections are fully and appropriately engaged. The invention is specifically useful when the electrical connections are in the form of coaxial, fixed diameter, multi-contact mating plug and socket means.

BACKGROUND OF THE INVENTION AND DESCRIPTION OF THE PRIOR ART

In certain applications it is necessary to connect two active (powered) electrical circuits together, typically by using a coaxial plug and socket connectors, each having mating diameters and with multiple circumferential mating spaced apart electrical contacts.

The procedure of engaging a multiple coaxial plug within a coaxial socket aperture so as to form the electrical connection with the multiple electrical contacts thereon will cause many of the contacts in the plug to "wipe" past those of the socket during insertion, generally in an electrically inappropriate manner, and may damage the electronic circuits associated with such contacts before the contacts are each fully and appropriately engaged with the corresponding electrical contact. In addition, a further problem arises in that the preferred method of making such electrical connections is typically to insert by rotationally screwing one tubular housing containing the plug into a similar tubular housing containing the socket. The environment in which this occurs could also be hazardous—for instance, on the floor of an oil-drilling rig where flammable gases may be present. In such circumstances it is advisable to make certain that no potentially live electrical contacts are capable of causing a spark or thermal effect that could ignite flammable gas, dust or vapor during rotatable insertion of the plug into the socket.

Still further problems exist with the hazardous environment in which such plus-socket connectors may be exposed. For example, drilling strings used in the oil industry require insertion therein of electronic monitoring and transmitting devices to allow drill operators to monitor various drilling parameters at the base of the well bore during drilling operations. Electronic devices which fit within the inner diameter of drill pipe of a drill string are typically cylindrical devices consisting of sensors, telemetry apparatus and batteries or power supplies, that together on average are less than 2 inches in diameter, and when connected can be 30 feet long. Such devices typically comprise specific pressure housings that require mechanical and electrical interconnections (contacts). These connection points are particularly vulnerable to severe shock and vibration, bending, compression and tension, high pressures and high fluid flow rates in the very harsh downhole-drilling environment.

Various methods have been developed and used in the industry to join, both mechanically and electrically, components of such electronic devices together in order to cope with the conditions of a drilling environment. The majority of these devices comprise a multi-contact plug and socket that cannot be rotated one into the other. Such connectors are firstly joined in a specified fashion and are then typically protected by a mechanical housing able to resist the downhole pressure. Many problems arise from the relatively complicated connection procedures necessary to connect such tool modules together, since not only must the longitudinal positioning of the two components be aligned but also they must be aligned properly in the angular sense relative to each other.

A simplification in the connection process that allows a more robust and reliable connection to exist utilizes a coaxial barrel style plug and socket design. Such design enables the plug to be attached to a housing, the socket attached to a similar housing and the pair are then simply pushed or screwed one into the other. Significant advantages that follow from the use of such a system are that smooth barrel joints are easily implemented, thereby minimizing flow erosion; mechanical complexity is reduced leading to more reliable systems and cost-effective implementations; and tool modules themselves can be housed in larger drill collars, enabling a simplification of the process whereby 'collar plus tool' is attached to another 'collar plus tool'.

One prior art design that is economical, basic and reliable involves a coaxial barrel style plug and socket having a single diameter. Such design would otherwise be the connector system of choice were it not for the following problems, namely, that when fully engaging a single diameter plug and socket many of the contact rings slide past each other. In a connection system of more than two contact rings (and hence more than two electrical lines) that may be electrically active, there is a danger that misappropriate or unsafe connections may be made thereby damaging associated electronic circuits.

A known prior-art method and configuration to avoid the above problem of "wiping" causing inappropriate electrical connection is to modify the spacing of the contacts on the plug and socket pair such that no more than a single contact is able to make contact with another before engagement. This method, and a plug and socket combination employing such a configuration, is taught in U.S. Pat. No. 6,439,932. The aforesaid method and configuration has the serious disadvantage that in order the ensure no more than one contact connection is allowed at any time prior to full engagement, the inter-contact spacings have to be implemented at increasingly large distances from each other. This leads to a costly, long and unwieldy plug and socket pair, particularly when more than six independent connections have to be made. For instance, a mathematical analysis will show that such a connector is more than twice the length of a normal coaxial connector implemented with uniform spacing.

A plethora of alternative schemes that use switching means that electrically isolate connections until the appropriate electrical connections are fully made and thus avoid the wiping problem are discussed below.

U.S. Pat. No. 6,528,746 shows a non-coaxial connector means that uses a magnet to activate a magnetic flux responsive device (typically a reed switch) that then enables connections to be made.

U.S. Pat. No. 5,048,914 shows a non-coaxial connector that uses an optical transmitter/receiver pair to activate its switches.

U.S. Pat. No. 5,580,261 teaches a means for connecting a single pair of coaxial contacts which relies on the mechanical motion of an internal switch, the switch means ultimately causing a mechanical connection of the contacts. This invention is typical of the class of mechanical movement initiating further connections.

Another class of mechanical switches is the subject of many inventions that rely on solid-state switches (electronic switches) to control further switched connections. U.S. Pat. No. 4,346,419 is an example of this area of prior art. It specifically teaches the use of non-coaxial contacts of differing lengths, a short pair (last to connect) that when connected enables a solid-state switch to pass relatively high current through other longer pairs of longer contacts. Disadvantageously, this design requires the last contact to be continuously supplied with a voltage. Accordingly, despite low "trigger" voltages being used, such configuration is nonetheless unsatisfactory in explosive environments due to the possibility of initiating an explosion.

Typical of modern coaxial connectors is the invention as shown in U.S. Pat. No. 6,435,917. This teaches an improved manner of maintaining a reliable connection specifically related to socket contacts. However, such design provides no protection against inappropriate connections being made when engaging plug into socket.

U.S. Pat. No. 5,984,687 and U.S. Pat. No. 5,409,403 are typical of rotatable coaxial connector patents. These examples teach the use in specific circumstances of placing each successive contact on a successively increasing diameter. The essential advantages of this class of design are that all contacts are made only when plug and socket are essentially fully engaged, and that plug and socket can rotate about a common axis. The disadvantages are that such devices are relatively expensive and usually require a significantly larger diameter implementation than a simple fixed diameter coaxial multi-contact plug and socket, such as is specified in the present invention. Furthermore, there is no means by which such devices alone could safely operate in an explosive or hazardous environment.

In conclusion, the prior art teaches the use of plugs and sockets in rotatable (coaxial) and non-rotatable forms that enable contacts to connect when a fully engaged position between plug and socket is achieved. The determination of this position is implemented via one or more of the following, namely:

- contact axial spacing differences;
- contact diameter spacing differences;
- mechanical movement of a probe enabling contacts to be connected;
- optical switch; and,
- a magnetic switch.

While these above prior art designs exist, there is a real need, however, for a plug and socket design which combines a number of features, namely:

- comparatively small in footprint;
- avoids the "wiping" problem;
- simple mechanical housing;
- can operate in hazardous environments; and
- relatively inexpensive relative to some of the prior art designs.

SUMMARY OF THE INVENTION

Our invention enables a multi-contact coaxial plug to be axially inserted into its partner socket while electronic circuits attached to either side of the plug and/or socket are isolated from any harmful electronic misalignment during the engagement procedure. The plug and socket do not require any particular contact spacing and so can be realized in the smallest appropriate volume i.e. small fixed diameter and short fixed contact spacings.

Accordingly, the invention, in one of its broad aspects, contemplates a very simple basic electrical diode attached to the plug, enabling a sensor circuit attached to the socket to activate various solid state switches to protect the socket's attached electronic circuitry and permit electrical supply of power only when the plug and socket combination are fully engaged, and a similar standard electrical diode attached to the socket enabling a similar sensor circuit attached to the plug to activate various solid state switches to protect the plug's attached electronic circuitry also only when the plug and socket combination are fully engaged. The sensor circuits are symmetric and allow the protection means to activate when either the plug's circuit only is implemented, when the socket's circuit only is implemented, or when both are implemented. A specific embodiment facilitates this activation for both circuits when either or both are electrically powered.

A specific advantage of our invention is that such electrical connections and disconnections can be safely undertaken in hazardous environments.

Specifically, the present invention in one of its broad embodiments comprises a multiconductor plug and socket means;

- said plug means having at least three electrically conducting plug contacts thereon, adapted for insertion in socket means;
- said socket means having a corresponding number of electrically conductive socket contacts thereon;
- a first of said plug contacts electrically coupled to a second of said plug contacts via a plug-side current direction-limiting means;
- a first of said socket contacts electrically coupled to a second of said socket contacts via a socket-side current direction-limiting means;
- said first and second plug contacts adapted for electrical communication with said first and second socket contacts only upon proper engagement of said socket means with said plug means; and
- circuit isolation means, said circuit isolation means only permitting flow of electrical current through one or more remaining plug-socket contact pairs when current flow through at least one of said plug-side and socket-side current direction-limiting means is detected.

The current direction-limiting device referred to above is typically a diode, but may be any combination of electrical or electronic circuits capable of providing this functionality.

In one refinement of the present invention, the circuit isolation means comprises plug-side circuit isolation means, said plug-side circuit isolation means only permitting flow of electrical current to at least one remaining plug contact when current flow through said socket-side current direction-limiting means is detected.

In an alternative refinement of the present invention, the circuit isolation means comprises socket-side circuit isolation means, said socket-side circuit isolation means only permitting flow of electrical current to at least one remaining plug contact when current flow through said plug-side current direction-limiting means is detected.

In a further refinement of the invention, where circuit isolation means is desired to prevent unintended shorting to electronic circuits on both the plug side and socket side of the electrical connection, the circuit isolation means comprises both plug side circuit isolation means and socket side circuit isolation means, both functioning as described above.

A timing circuit preferentially forms part of the circuit isolation circuit, and includes a delay from the time of connection between the plug means and socket means during which time electrical connection between the contacts must be fully established. One advantage of a timing circuit is that such a time delay prevents premature or intermittent contact associated with the current direction limiting means (typically a diode) from consequently triggering the establishment of electrical power to one or both of the plug contacts or socket contacts before full engagement of the plug means within socket means has been obtained.

In yet a further broad aspect of the present invention, the present invention comprises an apparatus for establishing electrical connection between a pair of electrical contacts, comprising:

plug means;

socket means;

said plug means having one of said pair of electrical contacts thereon and a further first and second electrical plug contact thereon, said plug means adapted for insertion in said socket means;

said socket means having the other of said pair of electrical contacts thereon, and a further first and second socket contact thereon;

said first of said plug contacts electrically coupled to said second of said plug contacts via a plug-side current direction-limiting means;

said first socket contact electrically coupled to said second of said socket contacts via a socket-side current direction-limiting means;

said first and second plug contacts adapted for electrical communication with said first and second socket contacts only upon proper engagement of said socket means with said plug means; and circuit isolation means, said circuit isolation means only permitting flow of electrical current through said pair of electrical contacts when current flow is detected through at least one of said plug-side and socket-side current direction-limiting means.

BRIEF DESCRIPTION OF THE DRAWINGS

The following drawings, showing preferred embodiments of the invention, are illustrative only, and for a complete definition of the scope of the invention, reference is to be had to the summary of the invention and the claims.

DETAILED DESCRIPTION OF PREFERRED EMBODIMENTS

Figure 1:
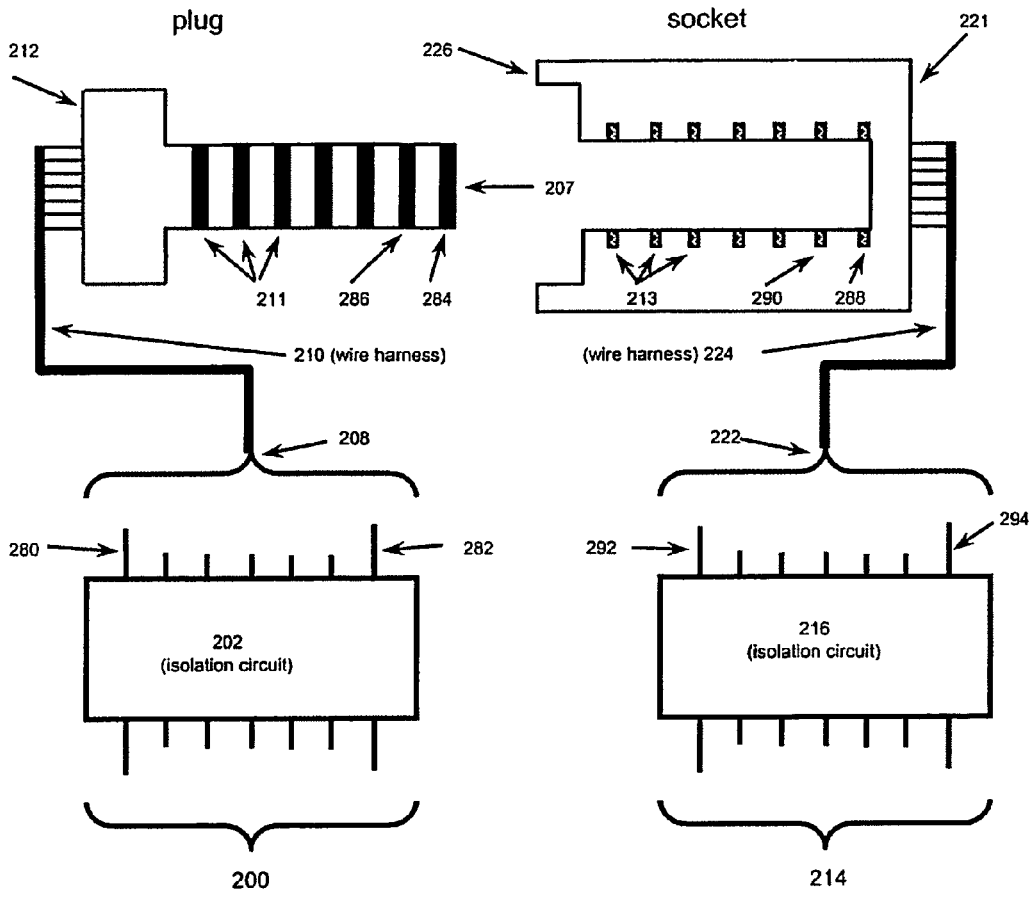
FIG. 1 is a schematic showing a generalized form of the coaxial plug and socket connection of the present invention.

While there are many methods of connecting two electronic circuits together, in one aspect the invention contemplates use of a coaxial plug and socket pair 212 and 226 respectively, as indicated in FIG. 1, each having a plurality of coaxially situate, concentric electrical contacts 211, 213 respectively thereon. The advantage of using such a coaxial multi-contact system is that the plug 212 and socket 226 can be housed in tubular containers (not shown) and the containers may be screwed together, thereby engaging the coaxial plug 212 into socket 226. The mechanical advantage of this method of engagement brings a disadvantage—the majority of the contacts 211, 213 wipe past each other during insertion of plug 212 into socket 226 before the plug 212 and socket 226 become fully engaged. This may cause damage to attached electronic components if they are activated by some power source. Accordingly, the invention provides for interposing specific isolation circuits 202 and/or 216 to isolate and protect such components during the engagement process. We accomplish this by connecting plug 212 via wire harness 210 to switching circuit 202. This circuit 202 isolates a variety of input/output lines (I/O) 200 from I/O lines 208. A pair of lines is dedicated to use as sensor lines (Sensor Line 1 280 and Sensor Line 2 282) and are attached to contacts 284 and 286 which are preferably but not necessarily at the distal end 207 of plug 212. Similarly we connect socket 226 via wire harness 224 to an isolation circuit 216. Circuit 216 isolates a variety of input/output lines (I/O) 214 from I/O lines 222. A pair of lines is dedicated for use as sensor lines (Sensor Line 1 292 and Sensor Line 2 294) and are attached to contacts 288 and 290, which are preferably, but not necessarily at the distal end 221 of socket 226.

Figure 2:
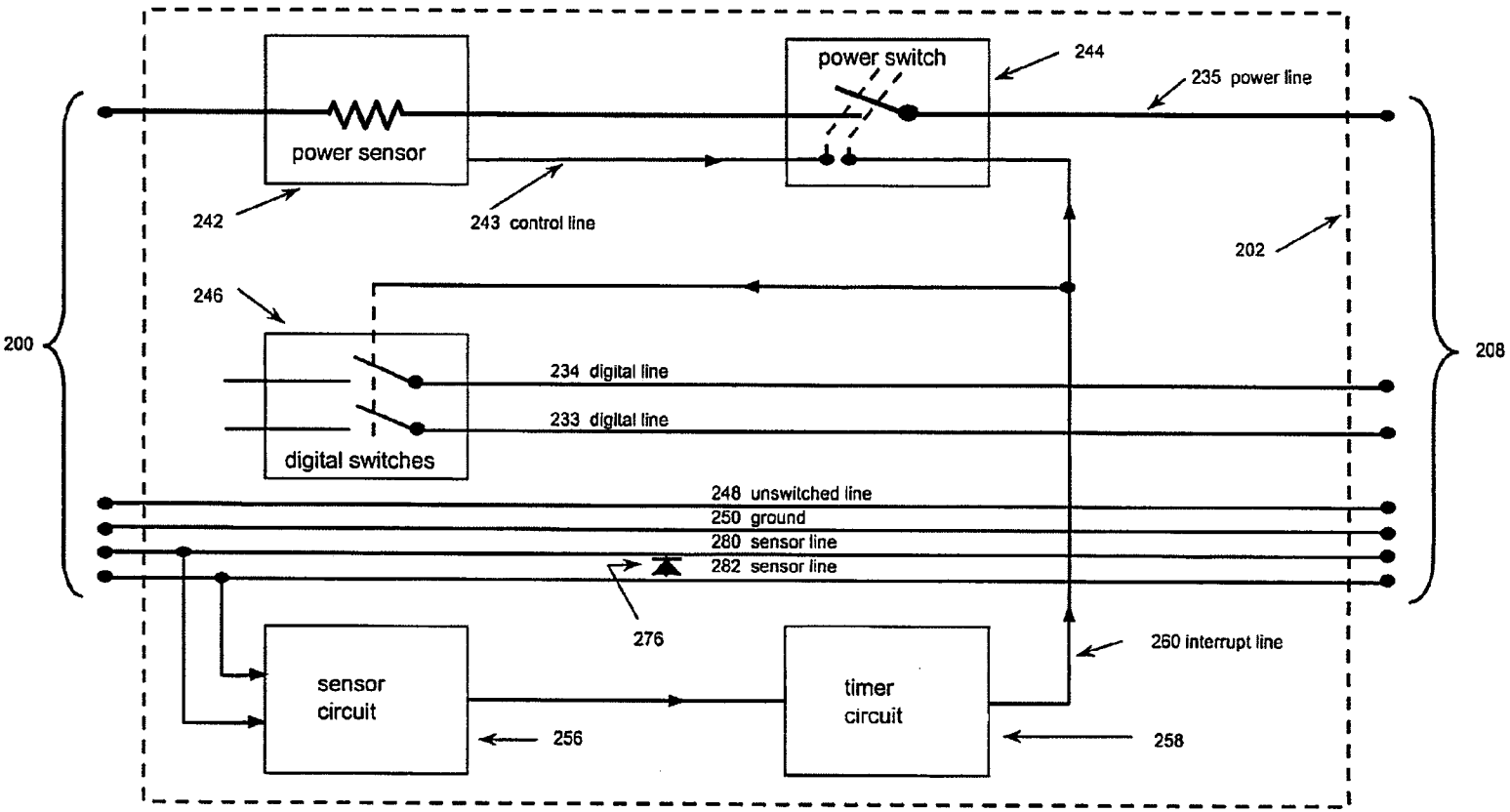
FIG. 2 is a more detailed schematic diagram of the isolation circuit for the plug isolating electronic switch circuit shown in FIG. 1.
Figure 3:
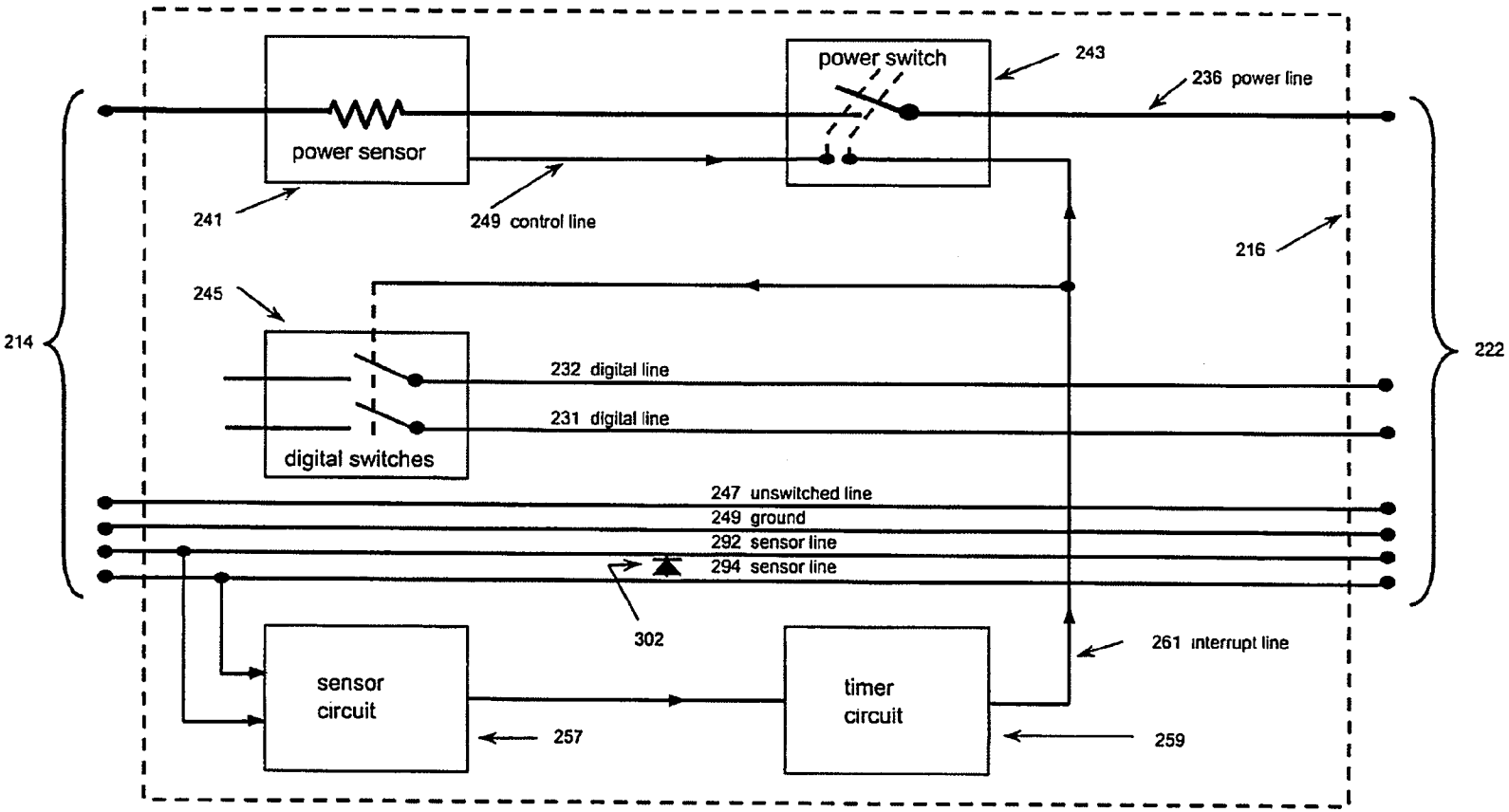
FIG. 3 is a more detailed schematic diagram of the isolation circuit for the socket side isolating electronic switch circuit shown in FIG. 1.

For simplicity of deployment we have designed circuit 202 to be identical to circuit 216 (ref. FIGS. 2 and 3) though this feature is not a required aspect of this invention. Although we indicate seven sets of corresponding electrical contacts associated respectively with plug 212 and socket 226, it is obvious that the number of sets of contacts applicable to this application can be any reasonable number greater than two, and the depiction of seven contacts is merely arbitrary and illustrative of the principles to be employed.

FIG. 2 is a more detailed schematic diagram of the isolation circuit 202 in respect of the plug contacts 211, as shown in FIG. 1. The I/O lines comprise a Power Line 235 monitored by Current Sensor 242 that controls Power Switch 244, Digital Lines 233, 234 controlled by Digital Switches 246, an Unswitched Line 248, a Ground Line 250, two Sensor Lines 280 and 282 controlled by Sensor Circuit 256, and Timer Circuit 258, the Timer 258 providing an Interrupt Line 260 to control Power Switch 244 and Digital Switches 246. A diode 276 is carried by Sensor Lines 280 and 282.

FIG. 3 is a more detailed schematic diagram of the isolation circuit 216 in respect of the socket contacts 213, as shown in FIG. 1. The I/O lines comprise a Power Line 236 monitored by Current Sensor 241 that controls Power Switch 243, Digital Lines 231, 232 controlled by Digital Switches 245, an Unswitched Line 247, a Ground Line 249, two Sensor Lines 292 and 294 controlled by a Sensor Circuit 257 and Timer Circuit 259, the Timer 259 providing an Interrupt Line 261 to control Power Switch 243 and Digital Switches 245. A diode 302 is carried by Sensor Lines 292 and 294.

Figure 4:
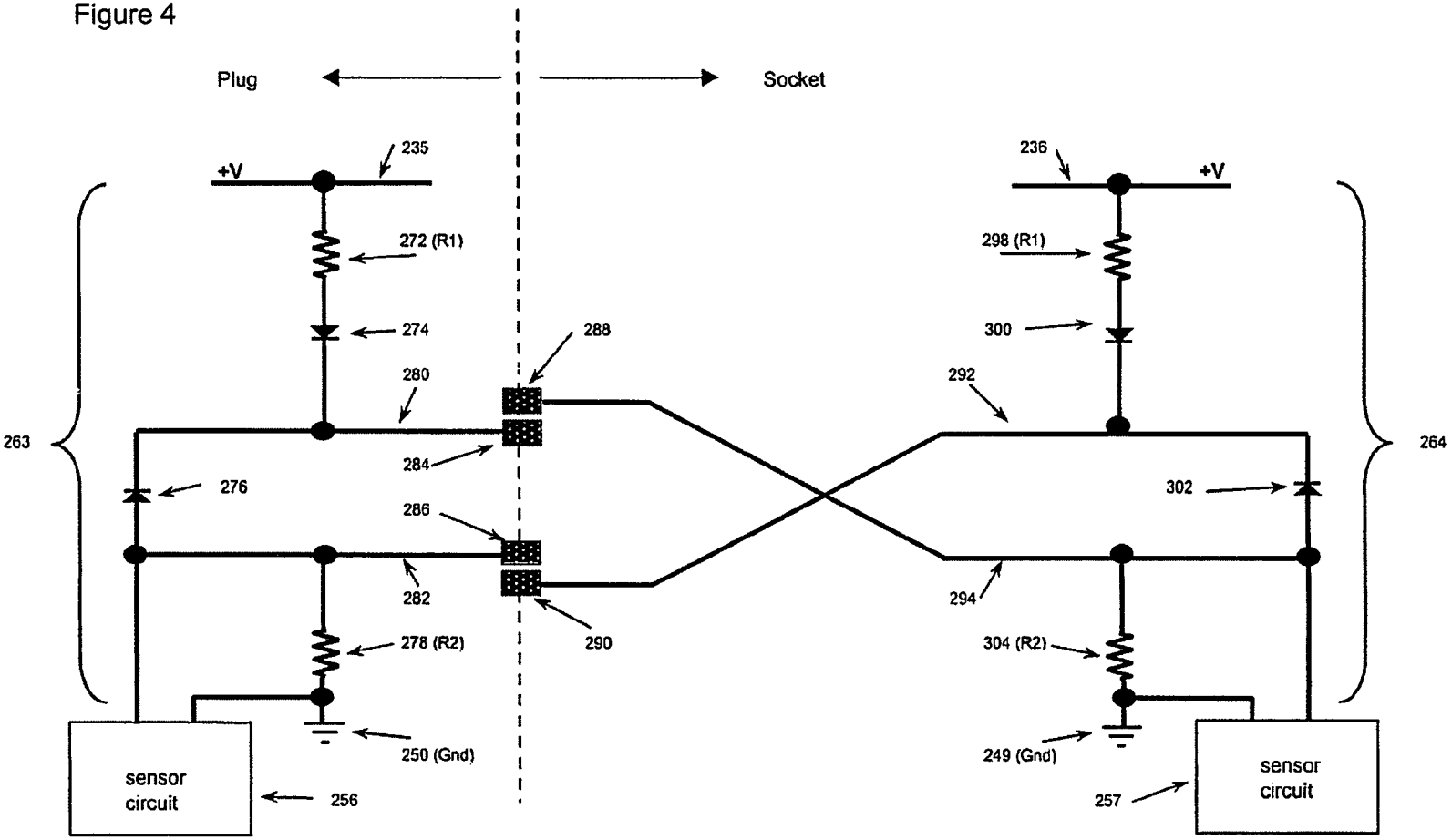
FIG. 4 shows plug Sensor Circuit Detection means 263 and socket Sensor Circuit Detection means 264 shown generally in FIGS. 2 and 3 respectively and how the Sensor Lines 292, 294 and 280, 282 are activated only by the full engagement of the plug 212 and socket 226. A positive potential +V on the plug sensor circuit side 235 is connected to a resistor R1 (272), then to a forward-biased diode 274, then to diode 276 that acts to block this current, and finally to another resistor R2 (278) that is grounded 250. Sensor Line 1 (280) from the junction of 274 and 276 is connected to plug contact 284. Sensor Line 2 (282) from the junction of 276 and 278 is connected to plug contact 286 and also to the plug Sensor Circuit input 256. Similarly, a positive potential +V on the socket circuit side 236 is connected to a resistor R1 (298), then to a forward biased diode 300, then to a [cliodel] diode 302 that acts to block this current, and finally to another resistor R2 (304) which is grounded 250. Sensor Line 1 (292) from the junction of 300 and 302 is connected to socket contact 290. Sensor Line 2 (294) from the junction 302 and 304 is connected to socket contact 288 and also to the socket Sensor Circuit input 257.

FIG. 4 shows plug Sensor Circuit Detection means 263 and socket Sensor Circuit Detection means 264 shown generally in FIGS. 2 and 3 respectively and how the Sensor Lines 292, 294 and 280, 282 are activated only by the full engagement of the plug 212 and socket 226. A positive potential +V on the plug sensor circuit side 235 is connected to a resistor R1 (272), then to a forward-biased diode 274, then to diode 276 that acts to block this current, and finally to another resistor R2 (278) that is grounded 250. Sensor Line 1 (280) from the junction of 274 and 276 is connected to plug contact 284. Sensor Line 2 (282) from the junction of 276 and 278 is connected to plug contact 286 and also to the plug Sensor Circuit input 256. Similarly, a positive potential +V on the socket circuit side 236 is connected to a resistor R1 (298), then to a forward biased diode 300, then to a diode 302 that acts to block this current, and finally to another resistor R2 (304) which is grounded 250. Sensor Line 1 (292) from the junction of 300 and 302 is connected to socket contact 290. Sensor Line 2 (294) from the junction 302 and 304 is connected to socket contact 288 and also to the socket Sensor Circuit input 257.

Figure 5:
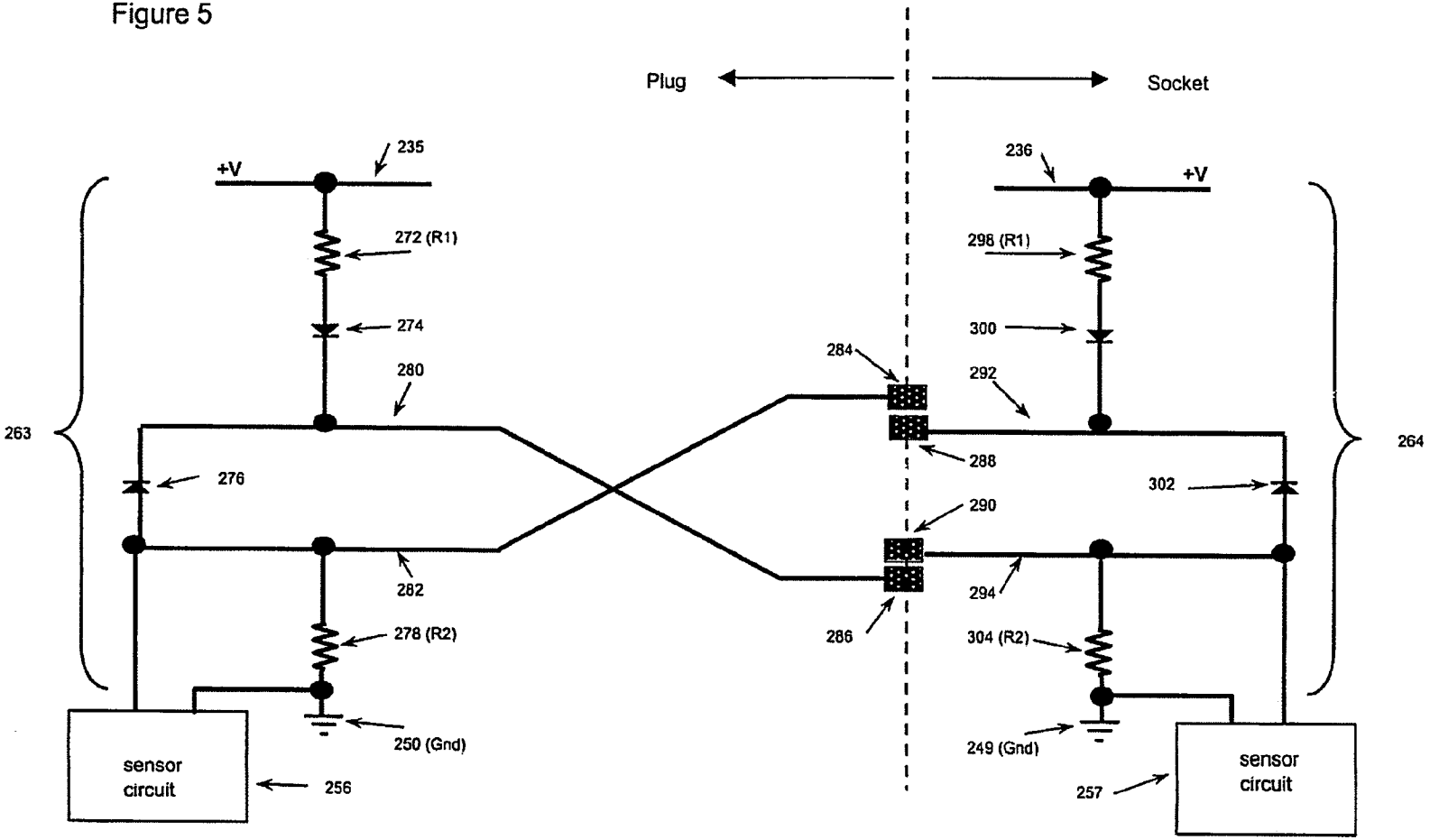
FIG. 5 is a sensor circuit similar to that shown in FIG. 4, but modified slightly to form an alternate embodiment.

It will be noted that the sensor lines 292, 294 on the socket Sensor Circuit Detection means 264 are crossed with respect to socket connections 288 and 290. Apart from this detail the full circuits and wiring for both plug and socket Sensor Circuits 256, 257 are identical. The plug-side and socket-side Sensor Circuit Detection means 263, 264 may alternatively be arranged as shown in FIG. 5, wherein Sensor Lines 280, 282 are crossed with respect to plug connections 284 and 286.

We proceed by explaining various embodiments in order to clarify how the system determines when the plug/socket combination has achieved full engagement.

Embodiment 1

Figure 6:
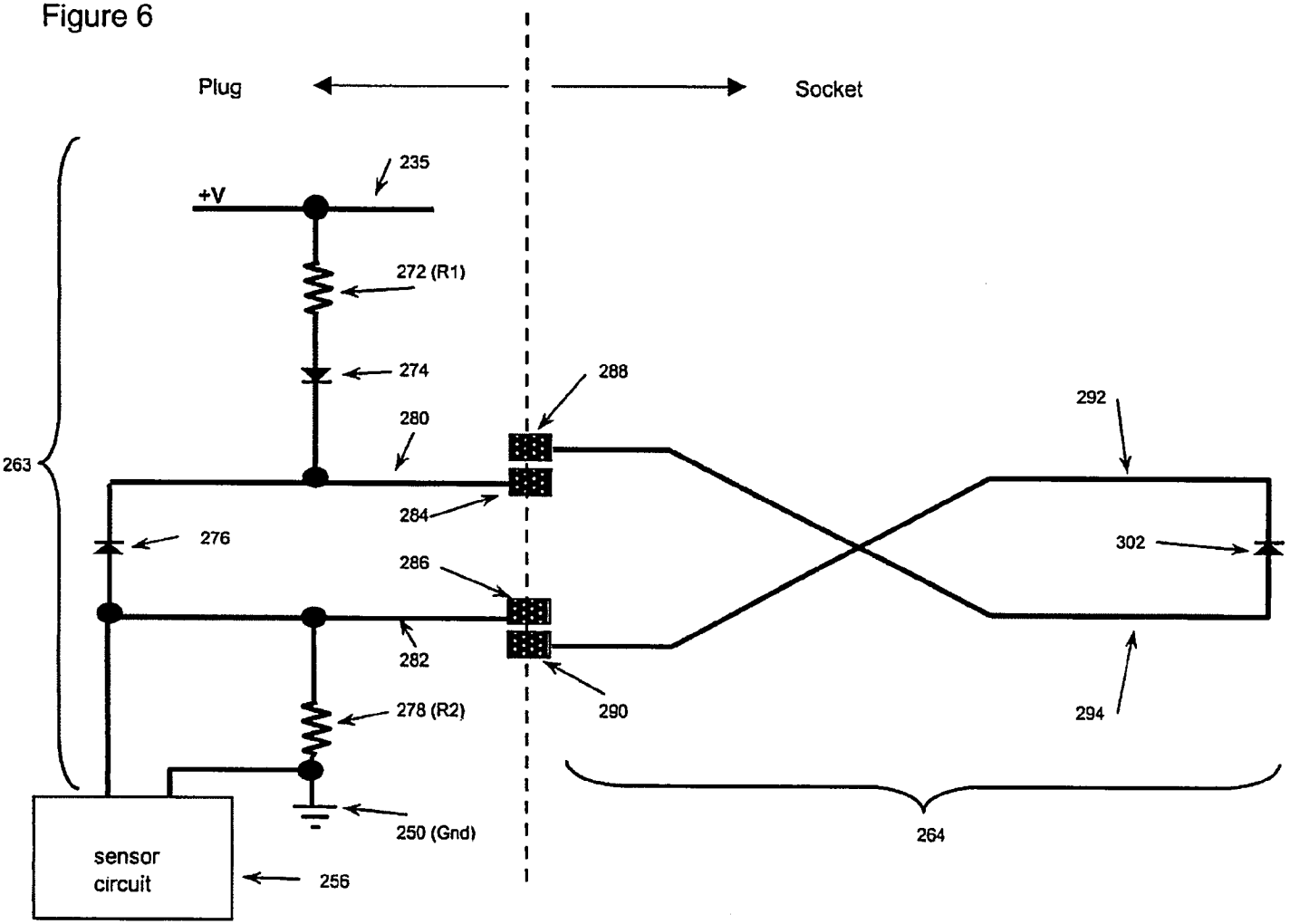
FIG. 6 shows schematically a sensor circuit, where only the plug side has associated isolation circuits and is electrically powered.

FIG. 6 denotes an arrangement where active powered electronic circuits are incorporated only on the plug side, and furthermore that electronic access to the plug side circuits does not require socket side isolation circuitry because the socket side is essentially passive. For illustrative purposes we set the power line +V at 15 volts, resistor R1 (272) is 50,000 ohms and resistor R2 (278) is 100,000 ohms.

As may be seen with reference to FIG. 6, the determination of the full engagement of plug 212 and socket 216 (whereby electronic circuitry which requires isolation occurs on the plug side) is achieved as follows. Current from supply line 235 flows through resistor R1 (272), through forward-biased diode 274 and is blocked from the plug sensor circuit output by diode 276. A current pathway is available across the plug/socket junctions 284 and 288, through diode 302 that now acts as a sensor activation element by passing current back through plug/socket junctions 290 and 286, and finally through resistor R2 (278) to Ground 250. The potential across resistor R2 (278) with respect to Ground 250 is sensed by the plug Sensor Circuit 256 to be approximately ⅔ times 15V (set by the potential divider R1/R2 i.e. ~10V). The threshold voltage necessary to activate the plug Sensor Circuit (256) could be set at 6 or 7 volts, greater than typical logic levels of 5V. Thus the activation voltage of ~10V is comfortably greater than the threshold, and false activations are minimized. Diode 302 is forward biased because of the crossed sensor lines 292 and 294 on the socket side. Were this not the case the required voltage potential at the plug Sensor Circuit 256 would not be available because no current could flow through resistor R2 (278), causing the appropriate activating voltage to be absent. Thus only when plug 212 and socket 216 are fully engaged is the plug Sensor Circuit 256 activated, and the switched lines forming part of the I/O bus 200 are then electrically connected to the I/O bus 208. Hence the switched (and also the unswitched) lines are correctly available at the socket via the fully engaged plug.

It will be obvious to one reasonably skilled in the art that there should be no electrical circuits associated with socket 226 such as Digital Switches 245 that are in electrical communication with any of the non-sensor contacts 213 that would be electrically mistaken for the action of diode 302, so as to otherwise initiate a "triggering" of the Power Switch 244. To further guard against such a possibility, in a preferred embodiment of this aspect of the invention the output of Sensor Circuit 256 in respect of the plug sensor circuitry is passed through timer 258 (ref. FIG. 2). The function of Timer Circuit 258 is to delay activation of Interrupt Line 260 controlling Power Switch 244 and Digital Switches 246 until the full engagement of plug 212 and socket 226 can be reasonably expected (typically one to two minutes).

The only significant requirements on the passive socket side is a diode 302 that is forward biased by crossed sensor lines 292, 294 in order that the Sensor Circuit 256 is correctly activated.

Embodiment 2

Figure 7:
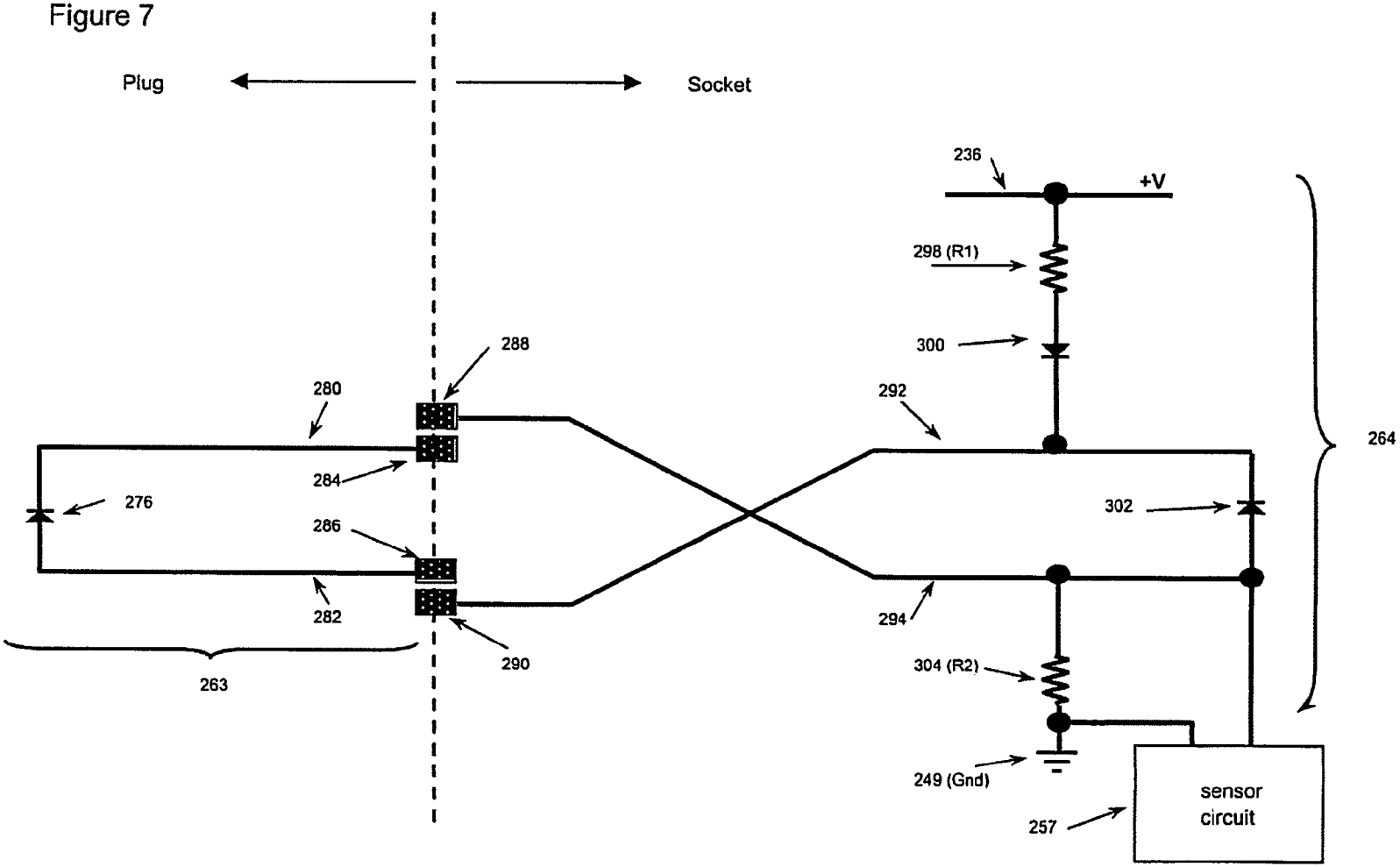
FIG. 7 shows schematically a sensor circuit, where only the socket side has associated circuits and is electrically powered; and, FIG. 8 is a schematic drawing showing a typical plug and socket connector which may be used in the present invention, indicating wiring connections that corresponds to the associated wiring of the respective plug and socket electrical isolation circuits.

The complementary circuit to Embodiment 1 is depicted in FIG. 7 and denotes an arrangement where active powered electronic circuits are incorporated only on the socket side, and furthermore that electronic access to the socket side circuits does not require plug side isolation circuitry because the plug side is essentially passive. For illustrative purposes we set the power line +V at 15 volts, resistor R1 (298) is 50,000 ohms and resistor R2 (304) is 100,000 ohms.

As may be seen with reference to FIG. 7, the determination of the full engagement of plug 212 and socket 216 (whereby electronic circuitry which requires isolation occurs on the plug side) is achieved as follows. Current from supply line 236 flows through resistor R1 (298), through forward-biased diode 300 and is blocked from the plug sensor circuit output by diode 302. A current pathway is available across the plug/socket junctions 290 and 286, through diode 276 that now acts as a sensor activation element by passing current back through plug/socket junctions 284 and 288, and finally through resistor R2 (304) to Ground 249. The potential across resistor R2 (304) with respect to Ground 249 is sensed by the socket Sensor Circuit 257 to be approximately ⅔ times 15V (set by the potential divider R1/R2 i.e. ~10V). The threshold voltage necessary to activate the socket Sensor Circuit (257) could be set at 6 or 7 volts, greater than typical logic levels of 5V. Thus the activation voltage of ~10V is comfortably greater than the threshold, and false activations are minimized. Diode 276 is forward biased because of the crossed Sensor Lines 292 and 294 on the socket side. Were this not the case the required voltage potential at the socket Sensor Circuit 257 would not be available because no current could flow through resistor R2 (304), causing the appropriate activating voltage to be absent. Thus only when plug 212 and socket 216 are fully engaged is the socket Sensor Circuit 257 activated, and the switched lines forming part of the I/O bus 214 are then electrically connected to the I/O bus 222. Hence the switched (and also the unswitched) lines are correctly available at the socket via the fully engaged plug.

The significant requirements on the passive plug side is a diode 276 that is forward biased by crossed sensor lines 292, 294 in order that the Sensor circuit 257 is correctly activated.

Embodiment 3

The discussion of Embodiment 1 and Embodiment 2 above now makes the complete understanding of Embodiment 3 as exemplified by either FIG. 4 or FIG. 5 straightforward. Both plug sensor circuit 236 and socket sensor circuits 264 are powered independently by +V (plug) 235 and +V (socket) 236 lines. Taking FIG. 4 for example, the voltage level output to Sensor Circuit 256 (plug) is available via either of two routes:

a) current from line 235 via resistor R1 (272) and diode 274 passes along Sensor Line 1 (280) to contacts 284 and 288, then via Sensor Line 2 (294) through diode 302, Sensor Line 1 (292), contacts 290 and 286, Sensor Line 2 (282) and through resistor R2 (278) to Ground 250. The potential at the junction of R2 (278) and Sensor Line 2 (282) with respect to Ground 250 is now available to activate the plug Sensor Circuit 256; or b) current from line 236 through resistor R1 (298) and diode 300 passes along Sensor Line 1 (292), through contacts 290 and 286, then via Sensor Line 2 (282) through resistor R2 (278) to Ground 250. The potential at the junction of R2 (278) and Sensor Line 2 (282) with respect to Ground 250 is now available to activate the plug Sensor Circuit 256.

The choice of routes a) or b) is determined solely by whether +V (plug) 235 is greater than +V (socket) 236 by more than one diode drop (typically 0.6V). In either case the significant issue is that the plug Sensor Circuit 256 is activated by an adequate +V (socket) 236 potential or by the presence of diode 302—both are associated only with the full engagement of the plug and socket, and either will suffice.

Likewise, the voltage level output to Sensor Circuit 257 (socket) is similarly available via either of two routes:

c) current from line 236 via resistor R1 (298) and diode 300 passes along Sensor Line 1 (292) to contacts 290 and 286, then via Sensor Line 2 (282) through diode 276, Sensor Line 1 (280), contacts 284 and 288, Sensor Line 2 (294) and through resistor R2 (304) to Ground 249 . The potential at the junction of R2 (304) and Sensor Line 2 (294) with respect to Ground 249 is now available to activate the plug Sensor Circuit 257; or d) current from line 235 through resistor R1 (272) and diode 274 passes along Sensor Line 1 (280), through contacts 284 and 288, then via Sensor Line 2 (294) through resistor R2 (304) to Ground 249 . The potential at the junction of R2 (304) and Sensor Line 2 (294) with respect to Ground 249 is now available to activate the plug Sensor Circuit 257.

Again, the choice of routes c) or d) is determined solely by whether +V (socket) 236 is greater than +V (plug) 235 by more than one diode drop (typically 0.6V). In either case the significant issue is that the socket Sensor Circuit 257 is activated by an adequate +V (plug) 235 potential or by the presence of diode 276—both are associated with the full engagement of the plug and socket, and either will suffice.

Diodes 274 and 300 ensure that there can be no unintended reverse current flow into their associated power supply from the power supply at higher potential on the other side of the plug/socket.

This embodiment illustrates usefulness of the symmetry of the circuit operations attached to either plug or socket—fabrication of the switching circuits is simplified in that both assemblies can be identical. The only necessary modification is that the lines must be crossed between contacts 288, 290 and Sensor Lines 292 and 294 (as shown in FIG. 4), or equally between contacts 284, 286 and Sensor Lines 280 and 282 (as shown in FIG. 5). In these embodiments, when plug and socket are fully engaged, FIGS. 2 and 3 indicate that the Power Switch lines (235, 236), Digital Switch lines (233, 234, 231, 232), the Unswitched Lines, Ground Lines and Sensor Lines are all connected appropriately. This enables power to flow as required from plug to socket or vice versa, digital information to flow as required from plug to socket or vice versa, etc.

Figure 8:
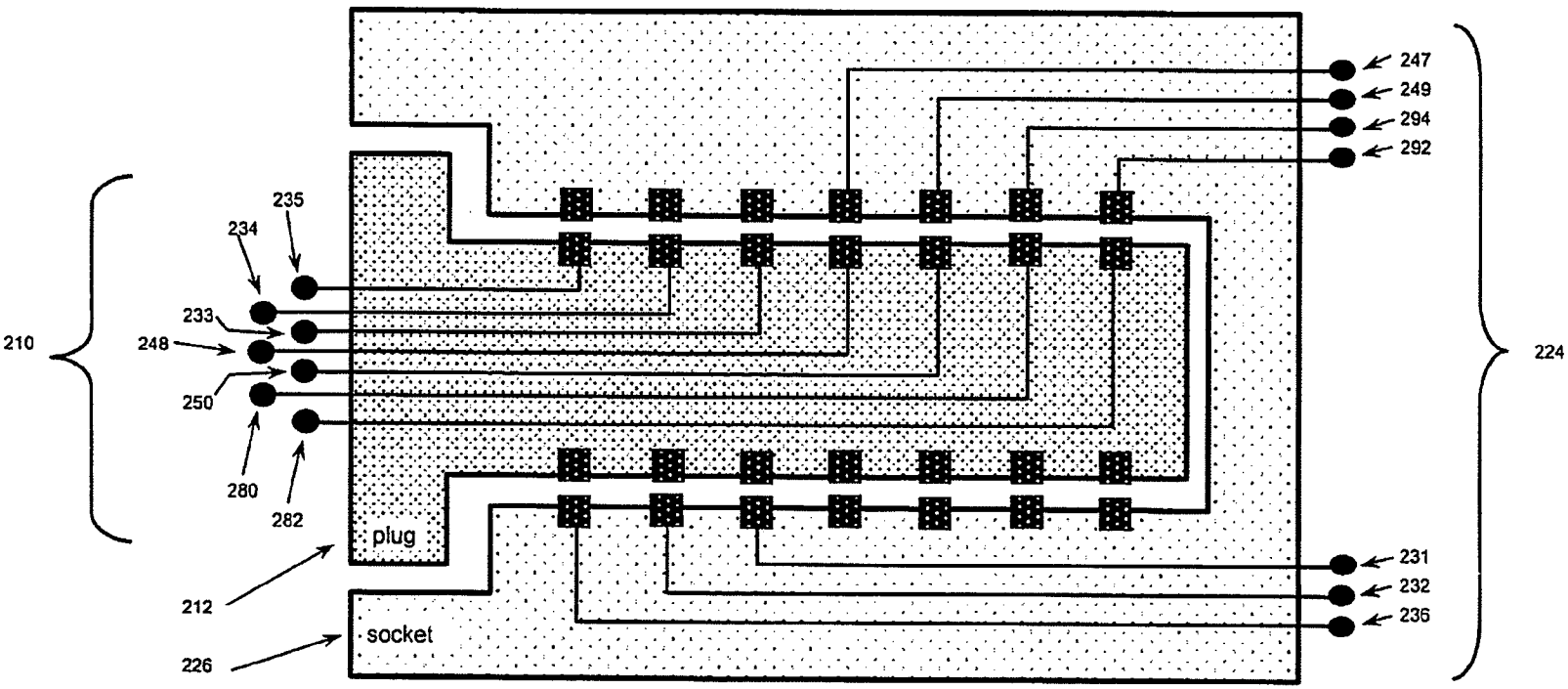

Our invention does not limit us to a 'one-to-one' line connection correspondence, however. The obvious inclusion of more contacts in plug 212 and socket 226 would enable the independence of the information or power carrying lines. The necessary and sufficient feature for determining full engagement is that plug Sensor Line 1 (280) connects to socket Sensor Line 2 (294) and plug Sensor Line 2 (282) connects to socket Sensor Line 1 (292) when diode 276 and/or diode 302 (for example) are chosen as the engagement sensing devices. Specific wiring connections through a representative plug and socket pair is depicted in FIG. 8. In particular the Sensor Line crossed wiring (282 to 292, 280 to 294) is evident.

Importantly, with respect to each of the embodiments shown in FIGS. 2 and 3, the present invention is not limited to a sensory circuit using only a simple diode as a sensing means. In particular, it is possible and is contemplated within the scope of the present invention to replace each diode 276 and/or 302 by other electrical circuitry, including current direction-limiting circuitry, so as to permit the sensor circuit to produce a particular electronic signal when specifically sensed at full engagement of the plug 212 and socket 226. The present invention is not to be limited to circuitry implementing only diodes 276 and 302.

We claim:

1. A coaxial multiconductor plug and socket means, said plug means having at least three electrically conducting plug contacts thereon, adapted for insertion in socket means;

said socket means having a corresponding number of electrically conductive socket contacts thereon;

a first of said plug contacts electrically coupled to a second of said plug contacts via a plug-side current direction-limiting means;

a first of said socket contacts electrically coupled to a second of said socket contacts via a socket-side current direction-limiting means;

said first and second plug contacts adapted for electrical communication with said first and second socket contacts only upon proper engagement of said socket means with said plug means; and circuit isolation means, said circuit isolation means only permitting flow of electrical current through one or more remaining plug-socket contact pairs when current flow through at least one of said plug-side and socket-side current direction-limiting means is detected.

2. The multiconductor plug and socket means as claimed in claim 1, wherein said circuit isolation means comprises plug-side circuit isolation means, said plug-side circuit isolation means only permitting flow of electrical current to at least one remaining plug contact when current flow through said socket-side current direction-limiting means is detected.

3. The multiconductor plug and socket means as claimed in claim 1, wherein said circuit isolation means comprises socket-side circuit isolation means, said socket-side circuit isolation means only permitting flow of electrical current to at least one remaining plug contact when current flow trough said plug-side current direction-limiting means is detected, 4. The multiconductor plug and socket means as claimed in claim 1, wherein said circuit isolation means comprises;

plug-side circuit isolation means, said plug side circuit isolation means only permitting flow of electrical current to at least one remaining plug contact when current flow through said socket-side current direction-limiting means is detected; and socket-side circuit isolation means, said socket-side circuit isolation means only permitting flow of electrical current to said at least one remaining plug contact when current flow through said plug-side current direction-limiting means is detected.

5. The multiconductor plug and socket means as claimed in claim 1, 2, or 3 wherein said circuit isolation means includes a time delay circuit.

6. The multiconductor plug and socket means as claimed in claim 1, 2, 3, or 4 wherein said current direction-limiting means is a diode.

7. A coaxial multiconductor plug and socket means, said plug means adapted for mating engagement with said socket means, comprising:

(i) first and second plug contacts situate op said plug means, electrically coupled to each other via plug-side current direction-limiting means;

(ii) first and second socket contacts, situate on said socket means and adapted to correspondingly come into electrical contact respectively with said plug contacts when said plug means is property and fully engaged with said socket means, said first and second socket contacts electrically coupled to each other via socket-side current direction-limiting means;

(iii) at least one additional plug contact and socket contact on each of said plug and socket means, respectively, each similarly adapted to come into electrical contact with each other when said plug means is fully engaged with said socket means;

wherein said plug and socket means are each adapted with circuit isolation means capable of only permitting flow of electrical current through said at least one additional plug and socket contact when current flow through at least one of said plug side and socket side current direction-limiting means is detected.

8. The multiconductor plug and socket means as claimed in claim 7, wherein said current direction-limiting means is a diode.

9. Apparatus for establishing coaxial electrical connection between a pair of electrical contacts, comprising:

plug means;

socket means;

said plug means having one of said pair of electrical contacts thereon and a further first and second electrical plug contact thereon, said plug means adapted for insertion in said socket means;

said socket means having the other of said pair of electrical contacts thereon, and a further first and second socket contact thereon;

said first of said plug contacts electrically coupled to said second of said plug contacts via a plug-side current direction-limiting means;

said first socket contact electrically coupled to said second of said socket contacts via a socket-side current direction-limiting means;

said first and second plug contacts adapted for electrical communication with said first and second socket contacts only upon proper engagement of said socket means with said plug means; and circuit isolation means, said circuit isolation means only permitting flow of electrical current through said pair of electrical contacts when current flow is detected trough at least one of said plug-side and socket-side current direction-limiting means.

10. The apparatus as claimed in claim 9, wherein said current direction-limiting means is a diode.

11. The apparatus as claimed in claim 9, wherein said circuit isolation means includes a time delay circuit.

12. A multiconductor plug and socket means arrangement, said plug and socket means sharing a common axis, said plug means having a plurality of plug contacts thereon, adapted for insertion in said socket means, said socket means having a plurality of socket contacts disposed thereon corresponding to said plug contacts, comprising:

a) a first plug contact of said plug contacts electrically coupled to a first diode, and at least one other plug contact electrically coupled to plug isolation means;

b) a first socket contact of said socket contacts electronically coupled to a second diode, and at least one other socket contact electronically coupled to socket isolation means;

c) the plug isolation means activated only when the second diode is detected by the full engagement of the plug and socket so as to then permit electrical current to flow to and/or from said at least one other plug contact thereon; and d) the socket isolation means activated only when the first diode is detected by the full engagement of the plug and socket so as to then permit electrical current to flow to and/or from said at least one other socket contact thereon;

wherein the at least one other plug contact is electrically coupled to the plug isolation means regardless of whether the plug and socket means are engaged or disengaged; and wherein the at least one other socket contact is electronically coupled to the socket isolation means regardless of whether the plug and socket means are engaged or disengaged.

* * * * *